United States Patent [19]

Winter et al.

[11] 4,426,856

[45] Jan. 24, 1984

[54] MEASURING ARRANGEMENT FOR DETERMINING A PROCESS VARIABLE OF A WINDING ARRANGEMENT

[75] Inventors: Karl Winter; Friedrich Gille, both of Obertshausen; Hans Lotz, Muhlheim, all of Fed. Rep. of Germany

[73] Assignee: Karl Mayer Textilmaschinenfabrik GmbH, Obertshausen, Fed. Rep. of Germany

[21] Appl. No.: 359,993

[22] Filed: Mar. 19, 1982

[30] Foreign Application Priority Data

Mar. 20, 1981 [DE] Fed. Rep. of Germany ..... 3111112

[51] Int. Cl.[3] ..... D04B 27/10

[52] U.S. Cl. ..... 66/212

[58] Field of Search ..... 66/209, 210, 211, 212; 242/45, 75.5, 75.51, 58; 139/97

[56] References Cited

U.S. PATENT DOCUMENTS

| | | | |
|---|---|---|---|
| 2,529,241 | 11/1950 | Bassist | 66/212 |
| 3,221,518 | 12/1965 | Bassist | 66/212 |
| 3,626,725 | 12/1977 | Fertig et al. | 66/212 |
| 3,668,904 | 6/1972 | Murenbeeld | 66/212 |
| 3,747,372 | 7/1973 | Nickell et al. | 66/209 |
| 3,780,541 | 12/1973 | Haynes | 66/210 |
| 3,781,532 | 12/1973 | Dorsman et al. | 66/212 |
| 3,858,415 | 1/1975 | Wilson et al. | 66/210 |

*Primary Examiner*—Ronald Feldbaum
*Attorney, Agent, or Firm*—Omri M. Behr

[57] ABSTRACT

A measuring arrangement for a machine winding arrangement can determine a process variable related to the length of a wound-up or let-off material. A rotational angle signal is extracted from a rotatable winding carrier. In addition this angle signal can also contain information concerning the direction of rotation of the winding arrangement. The process variable is then calculated from this turning angle signal and calculation data, by means of a computer. The calculation data, transmitted from an input device, include at least values which are concerned with the diameter of the winding and thickness of the winding layer. The computer can contemporaneously be utilized to calculate the desired amount of rotation of a beam motor from: the process variable, a setting amount from the input device and a main shaft signal indicating rotation of the main shaft of the winding arrangement. The arrangement is particularly suited for the winding up or letting off of thread of a textile machine.

6 Claims, 2 Drawing Figures

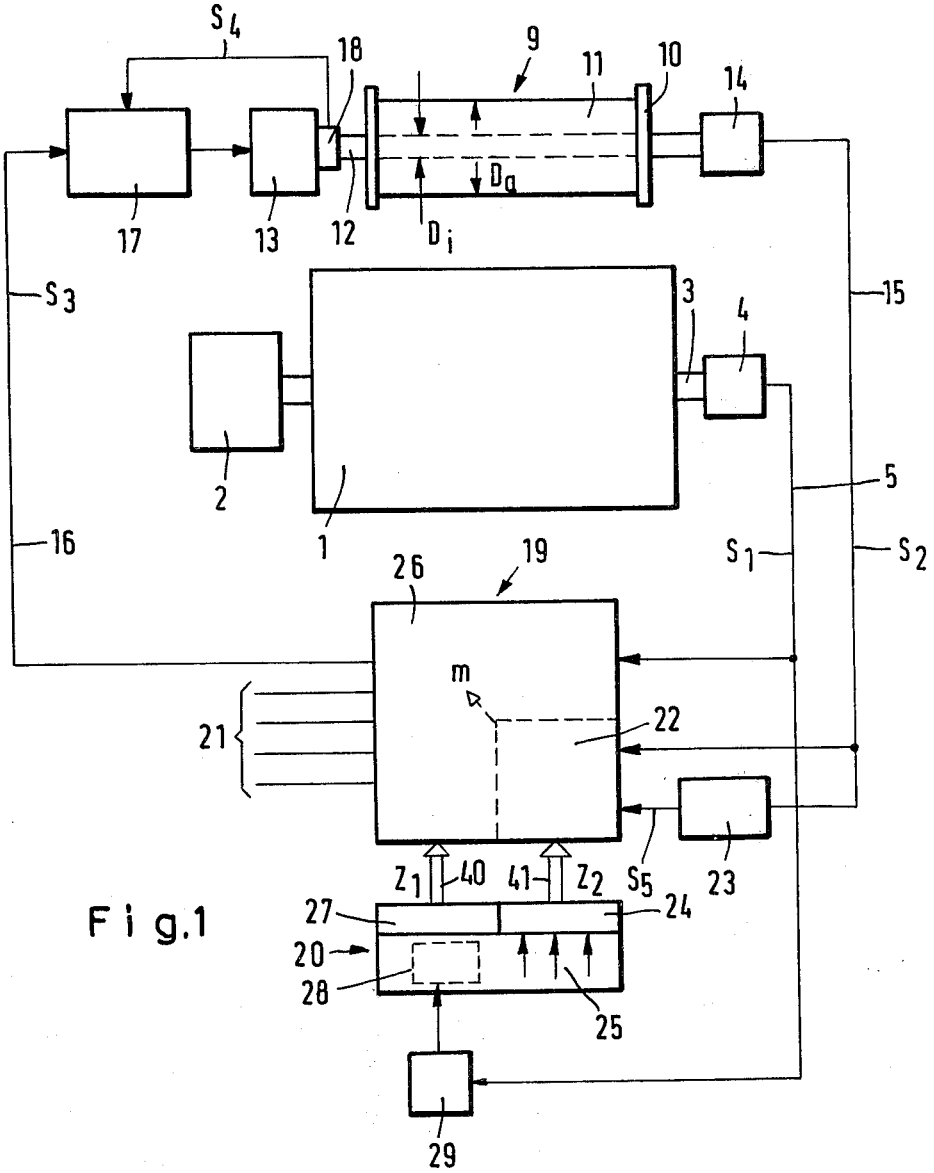
Fig.1
Fig.2
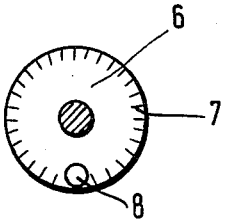

MEASURING ARRANGEMENT FOR DETERMINING A PROCESS VARIABLE OF A WINDING ARRANGEMENT

BACKGROUND OF THE INVENTION

1. Field of the Invention

The present invention is concerned with a measuring arrangement for a winding arrangement, suitably for a textile machine, to determine the process variables relates to the length of material, such as thread, let-off or taken-up; by means of a signal generator provided to a rotatable winding carrier.

2. Discussion of the Relevant Art

In a measuring arrangement of this type (German published application DE-OS No. 2,351,431), a roller is provided to the outer circumference of a thread winding on a partial warp beam. This roller is caused to rotate by frictional action and therefore is turned in accordance with the speed of thread let-off. The rate of rotation of the roller is converted into pulses which correspond to a predetermined thread length. These pulses are provided to a control arrangement which drives the motor of the partial warp beam in dependence upon the rotation of the main shaft of the principal warp knitting machine and a setting amount, so that for each rotation of the main shaft a predetermined length of thread is let-off from the warp beam.

When utilizing a length-measuring arrangement such as a roller, it has been found that errors of the order of 3% must be taken into account. This occurs, among other reasons, because: a. a certain amount of slippage is unavoidable, b. the roller, under influence of its own mass and depending upon the hardness of the warped thread, pushes itself into the winding to a greater or lesser extent, and c. the extent of mutual contact between the roller and the winding changes, depending upon the actual diameter of the winding.

Thus there is a need for a measuring arrangement of the hereinbefore described type which provides with greater precision, this process variable that depends upon the length of the taken-up or let-off material such as thread.

SUMMARY OF THE INVENTION

A measuring arrangement according to the principles of the present invention can determine a process variable related to the length of material transfer for a rotatable winding carrier, suitably, of a textile machine. The arrangement includes a rotational angle measuring means coupled to the carrier for generating a rotational angle signal signifying the rotation of the carrier. The arrangement also includes an input means for providing predetermined calculation data. This data includes at least values corresponding to the winding diameter of and the layer thickness of the winding carrier. Also included is a computing means coupled to the input means and the angle measuring means for computing the process variable from the calculation data and the rotational angle signal.

By using such equipment, according to the principles of the present invention, a rotational angle measuring means acting as a signal generator can provide a rotational angle signal and an input arrangement can provide constant computation data, which include at least a diameter of the winding and a value depending on the thickness of the winding layer. Preferably, a computer computes the process variable from the turning rotational angle signal and the constant computation data.

In a preferred embodiment, the rotational angle measuring means provides a single pulse for each predetermined degree of rotation, to a counting means. This counting means provides the number of rotations as a variable calculating quantity. Such pulses may be very readily generated since only one pulse generator is required which is activated by triggering elements rotatable by the winding carrier. In the simplest case, one is concerned with an optical trigger mechanism activated by marks on the winding carrier. It is, of course, also possible to utilize magnetic, mechanical or other trigger mechanisms. The counting means can also be readily activated by such pulses and may be a forwards-backwards counter whose direction of count depends upon the direction of rotation of the winding arrangement. Thus, the rotational angle signal should also contain information with respect to the rotational direction of the winding arrangement so that both desired and undesired reverse rotation can be taken into account.

BRIEF DESCRIPTION OF THE DRAWINGS

In order that the invention may be more fully understood, it will now be described, by way of example, with references to the accompanying drawings in which:

FIG. 1 is a schematic representation of the measuring arrangement according to the principles of the present invention in conjunction with a warp knitting machine; and FIG. 2 is a schematic representation of a pulse-generating device for measuring the degree of rotation of equipment in FIG. 1 such as the warp beam.

DESCRIPTION OF THE PREFERRED EMBODIMENT

Referring to FIG. 1, a textile machine, shown as warp knitting machine 1, comprises drive motor 2 and main shaft 3 which controls all of the apparatus of machine 1 concerned with the work cycle of the knitting needles (not shown). Rotational angle measuring device 4 is connected with main shaft 3 and generates main shaft signal S1. Signal S1 comprises pulses, that is to say, a single pulse for each predetermined angular increment of rotation. Signal S1 is transmitted over lead 5. As an example, rotational angle measuring means 4 can have the form shown in FIG. 2 wherein the disc 6 has a plurality of equi-distant, peripheral indicia 7 which can be detected by an electro-optical converter 8, such as a photoelectric transistor. Disc 6 is driven by main shaft 3 (FIG. 1) to produce a pulse from converter 8 whenever shaft 3 advances by a predetermined increment. These readout signals can also be generated by other means; for example, magnetic, mechanical or electrical means, to yield means equivalent to first signal generator 4.

Knitting machine 1 cooperates with a winding arrangement 9, shown employing a rotatable winding carrier for the provision of thread. Carrier 9 is represented herein as partial warp beam 10 carrying the warp threads upon it as winding 11. It will be appreciated that other types of warp beams may be used instead. Partial warp beam 10 is driven via shaft 12 by DC motor 13. In one embodiment motor 13 was a HYTORK direct current servomotor No. T5F2-B manufactured by BBC Lampertheim, Federal Republic of Germany. The shaft 12 is also connected with a rotational angle measuring means 14 which has the same construction as angle measuring means 4. In one embodiment turning angle measuring devices 4 and 14 were incremental rotation indicators ROD 420, manufactured by Dr. Johannes Heidenhain, Traunreut, Federal Republic of Germany. Thus, via line 15, there is transmitted a turning angle signal S2, which again comprises a series of pulses each signifying a small angular increment of rotation of beam 10. The direction of rotation of beam 10 can be sensed by producing from generator 14, differentiable pulses whose production depends on the direction of rotation. The differentiable pulses can be, for example, positive and negative pulses. Alternatively, signal S2 can be multiplexed signals or signals on multiple lines so the directional information can be separately sensed.

The desired rate of rotation of motor 13 is specified by rotational signal S3 on line 16 which can constitute, for example, a variable input voltage. The rate of rotation of motor 13 is measured by tachometer 18 connected to shaft 12 to produce a feedback signal S4. In one embodiment tachometer 18 was a direct current tachometer FC12-T, manufactured by BBC. The line bearing signal S4 is connected to one input of DC amplifier 17, its other input 16 being connected to the line bearing signal S3. Amplifier 17 is connected to motor 13 to regulate its speed. Thus connected, DC amplifier 17 forms a small control circuit, feedback signal S4 from the tachometer acting with motor 13 to provide rate feedback. In one embodiment amplifier 17 was a double current converter GAB manufactured by BBC.

A computing means is shown herein as computer 19. Its inputs include lines 15 and 5 and its outputs include lines 21 and 16. Outputs 21 of computer 19 indicate that computer 19 can be used as a controller for other rotating arrangements; for example, other partial warp beams providing with control circuits. Computer 19 cooperates with an input means 20 which provides input data on buses 40 and 41. While in some embodiments arrangement 20 can be a digital computer or an analog signal generator, in this embodiment arrangement 20 is a digital memory, preprogrammed as set forth hereinafter. The data memory of input arrangement 20 has a plurality of addresses for the storage of different setting sizes and these addresses are called according to main beam signals S1 to change the settings for the control arrangement as explained further hereinafter.

The digital computer 19 calculates the desired rotational signal S3 for motor 13 from the main shaft signal S1 and the rotational angle S2 as well as other data which are provided by input arrangement 20. The data comprise setting sizes Z1 which determine which thread lengths should be released from warp beam 10 per revolution of main shaft 3 and computing data Z2 which, by use of the rotational angle signal S2, permits the calculation of the actual release thread length, corresponding to a process variable set forth in detail hereinafter.

By choice of the appropriate addresses, the appropriate setting size for the desired work cycle may be provided to affect motor 13 as explained further hereinafter. Another possibility exists wherein input arrangement 20 is provided with a computation means which, in dependence upon main shaft signal S1, calculates different setting amounts dependent upon a preset calculation program. The foregoing setting sizes Z1 determine what length of thread should be delivered per revolution of main shaft 3 from warp beam 10.

A portion 22 of computer 19 is used to calculate process variable m, a scaling quantity indicating the length of thread currently delivered for each pulse of turning signal S2. To this end, the output of counter 23 is connected to line 15 to receive feedback signal S2. Counter 23 is an up/down counter whose mode of counting depends upon the information supplied by the feedback signal S2 about the turning direction of warp beam 10. Thus, counter 23 is incremented or decremented according to the angular rotation of beam 10 to exhibit a count signifying the net angular displacement of beam 10. This feature is useful if beam 10 should reverse direction. Also given to computing means 22 as predetermined calculation data Z2 are the following: internal diameter D1 of winding 11 (that is, the diameter of the warp beam axis), the outer diameter Da of winding 11 and the number of layers of winding. Instead of providing the outer diameter Da, it can be calculated from the thickness and the number of the layers. Other combinations of known quantities may also be utilized. Such data may be fed into portions 24 of the input arrangement 20 by means of a setting arrangement 25. This data from setting arrangement 25 may originate from external or internal data logs, may be established manually or by other means, when the warp beams or the patterns are changed.

To obtain the measurement size m the computer 19 operates in accordance with the following formula:

$$m(1) = \frac{\pi\alpha_0}{360}\left(Da - \frac{d\Sigma\alpha_0}{360}\right) \tag{1}$$

Wherein, m(1) is the thread length delivered for each pulse of turning angle signal S2; $\alpha_0$ is the angular increment for each pulse; Da is the outer diameter of the winding 11; and d is the thickness of the winding layer.

The summation of the turning angle $\alpha_0$ occurs in counter 23 so that the sum of the turning angles with respect to 360° is equal to the number of rotations of the warp beam 10 during the foregoing letoff. Of course in other embodiments this summation can be performed within computer 19.

This process variable m is compared with the input size signal Z1 and the main shaft signal S1 in part 26 of computer 19 in such a manner that the turning signal S3 is adjusted to cause a predetermined thread length for each revolution of main shaft 3. This setting size signal is found in portion 27 of the input arrangement 20 and is read from data memory 28 in dependence upon address selector 29. The address selector is controlled by the main shaft signal S1. As an example, for patterning knitted goods two or more setting size signals can be transmitted from data memory 28 into input portion 27 in accordance with a program of a predetermined number of revolutions of main shaft 3. Accordingly, a pattern is developed over successive working cycles of warp knitting machine 1. In one embodiment computer 19 with input arrangement 20 and address choosing means 29 was an 8-Bit Microcomputer made from INTEL 8041 UPI and INTEL 8039 RAM, EPROM, manufactured by INTEL Corporation, Santa Clara, California, U.S.A.

In operation, computer 19 responds to shaft signal S1 and feedback signal S2 and the data which are generated by input arrangement 20, to produce the desired rotational speed signal S3 for motor 13 as follows: Assuming that computer 19 has recently generated a signal on line 16, motor 13 is held by the inner loop including tachometer 18 to a velocity proportional to signal S3. When the next pulse is applied along line 15 to counter 23, its count increases by one. Consequently computer 19 can either immediately or within a programmed time period, recalculate the value of the measurement size m according to equation 1. Since the summation continually increases, the value of m continually decreases, indicating the need for a higher angular speed for warp 10 as it unwinds, to maintain a constant rate of thread consumption. Computer 19 measures the number (or frequency) of pulses in line 15 over a given number (or portion) of machine cycles, as determined by the pulses of main shaft signal S1. For example, computer 19 can keep a running total by incrementing the total by the current value of m everytime a pulse appears on line 15. Where this total kept for 480 courses, the total would be equivalent to rack length. However, it is expected that the thread consumption will be examined more frequently to increase response time. In any event, the consumption value thus obtained is compared to the thread consumption required by signals of the setting sizes Z1. If the measured consumption is in error due to, for example, a reduction in the diameter of warp 11, computer 19 adjusts the signal on line 16 to adjust the speed of motor 13 accordingly until the desired and measured consumption coincide.

It will be appreciated that the measurement of rates by totalling pulses is equivalent to measuring a ratio and can be performed in other ways. For example, the periods of different pulse trains can be measured and converted to a ratio directly by a dividing subroutine in computer 19.

Eventually address selector 29 observes that a predetermined number of machine cycles has elapsed. Thereafter selector 29 calls for the next values for setting sizes Z1. This change causes a corresponding change in the speed of motor 13. Thus input arrangement 20 provides for a program with many input sizes which can be called out sequentially by the control arrangement 20 in dependence upon main shaft signal S1. Accordingly, warp knitting machine 1 is driven with a substantial number of differences of rotational rates of its rotating elements. The switch from one rate of revolution to the other proceeds automatically upon receipt of the main shaft signal which, in any event, must be provided for other reasons. It therefore becomes possible, by the alteration of the rate of rotation of the partial warp beam 10 (or warp beam) to produce goods which, within itself contains sections having loose stitches, tight stitches, and stitches with intermediate tension. It is thus possible to produce within the goods itself variations of thread density, the appearance of pleats, and the like. All of this can occur automatically by means of such a program.

The foregoing operation is accurate since it uses the turning angle signal S2 taken from the winding arrangement 9. This may be done with the highest and most reliable precision. Also, the input data Z2 can be exactly determined since it is possible to measure the initial diameter and the final diameter of the winding with great precision and, since the number of winding layers is known, the winding layer thickness may be readily determined. Furthermore, these input data Z2 may be readily confirmed by a single test run. In the calculation of the process variable m from the turning angle signal S2 and the basic input data Z2, it is only necessary to take into account the fact that as the diameter of winding 11 decreases, the amount of thread length per rotational angle unit will also decrease. This reduction is proportional to the rotation of the winding arrangement 9. The rotational angle signal S2 thus provides the computer 19 not only with an initial value for the calculation of process variable m, but also a correction value for taking into account the change in the winding diameter. Experiments have shown that in this manner, very high measuring accuracy is possible. The margin of error is less than 1%.

The process variable m does not have to be the thread length itself. One may also deal with process variables dependent upon the thread length. For example, the thread speed, the thread length per rotation of machine main shaft 3, and other factors. Furthermore, the measuring arrangement may be utilized not only for the let-off of thread, but also in the take-up of thread, for example, during the warping of the warp beams.

The preferred embodiment determined the process variable m for a warp beam or partial warp beam of a warp knitting machine in order to control the beam motor in proportion to: the process variable m, a signal S1 generated by the turning angle of main shaft 3 and a setting sizes Z1. Preferably this control is such that for each rotation of the main shaft, a predetermined thread amount is let-off. It is therefore a substantial advantage if computer 19 calculates not only the process variables but the desired amount of rotation of the warp beam motor, based upon the process variables, the main shaft signal S1 and the setting sizes Z1. Controlling the rotational amount of motor 13 by means of a computation process gives rise to very great exactness. This, in combination with the exact calculation of the process variable m, leads to very precise control. Furthermore, certain simplifications arise due to this multiple utilization of the computer.

In this connection it is useful if the input arrangement comprises a data logger which takes up different input amounts under different addresses, as well as an address chooser controlled by the main shaft signal S1. This leads to a programmable control of the thread provision to the warp knitting machine 1 dependent upon the main shaft 3. It is possible to thus provide very different thread let-off speeds for each predetermined number of working cycles, which permit a far greater choise of pattern. It should be noted that the data logger can be utilized for two purposes, that is to say not merely for the setting sizes Z1, but also for different computation data Z2 which in turn leads to further simplification.

It will be understood that various changes in the details, materials, arrangement of parts and operating conditions which have been herein described and illustrated in order to explain the nature of the invention may be made by those skilled in the art within the principles and scope of instant invention.

Having thus set forth the nature of the invention, what is claimed is:

1. A measuring arrangement for determining a process variable related to the length of material transfer for a rotatable winding carrier comprising:

a non-contacting rotational angle measuring means coupled to and actuated by said carrier for generating a rotational angle signal signifying the rotation degree and direction of said carrier;

an input means for providing predetermined calculation data, said data including at least values corresponding to the winding diameter of and the layer thickness of said winding carrier; and computing means coupled to said input means and said angle measuring means for computing said process variable from said calculation data and said rotational angle signal.

2. A measuring arrangement according to claim 1 wherein said angle measuring means produces said rotational angle signal with information about the direction of rotation of said winding carrier.

3. A measuring arrangement according to claim 1 wherein said angle measuring means provides a single pulse for each predetermined angular incrementation of said winding carrier, said measuring arrangement further comprising:

a counter coupled to said angle measuring means for counting its pulses and providing the current total to said computing means, said computing means being operable to compute said process variable in dependence on said current total.

4. A measuring arrangement according to claim 3 wherein said angle measuring means produces said rotational angle signal with information about the direction of rotation of said winding carrier and wherein said counter is operable to count up and down in dependence upon the direction of rotation of said winding carrier.

5. A measuring arrangement according to claim 1 wherein said carrier comprises a beam, of a warp knitting machine, adapted to be wound with warp thread, said warp knitting machine including a main shaft and a warp beam motor having a control input, the speed of said motor being alterable by altering the electrical drive applied to said control input and wherein said input means is operable to provide a setting size signal corresponding to a given thread consumption rate, said measuring arrangement further comprising:

a rotational angle measuring device coupled to said main shaft for generating a main shaft signal signifying the rotation of said main shaft, said computing means comprising:

means responsive to said main shaft signal and said setting size signal and coupled to said control input of said warp beam motor for calculating and applying thereto a driving signal bearing a predetermined relation to said process variable, said main shaft and said setting size signal, said driving signal being sized to cause said beam to transfer a predetermined amount of warp thread for each rotation of said main shaft.

6. A measuring arrangement according to claim 5 wherein said input means comprises:

a data memory for storing a plurality of values for said setting size signal at different addresses; and an address selector responsive to said main shaft signal for sequentially retrieving said values in said memory for said setting size signal and applying them to said computing means.

* * * * *